US011761187B2

(12) United States Patent
Hauth

(10) Patent No.: US 11,761,187 B2
(45) Date of Patent: Sep. 19, 2023

(54) TOILET CISTERN WITH BIDET SPRAY HEAD AND INJECTOR, AND USE THEREOF

(71) Applicant: Neoperl GmbH, Mullheim (DE)

(72) Inventor: Matthias Hauth, Todtnau/Muggenbrunn (DE)

(73) Assignee: NEOPERL GMBH, Mullheim (DE)

( * ) Notice: Subject to any disclaimer, the term of this patent is extended or adjusted under 35 U.S.C. 154(b) by 0 days.

(21) Appl. No.: 16/485,271

(22) PCT Filed: Feb. 15, 2018

(86) PCT No.: PCT/EP2018/053734
§ 371 (c)(1),
(2) Date: Aug. 12, 2019

(87) PCT Pub. No.: WO2018/188836
PCT Pub. Date: Oct. 18, 2018

(65) Prior Publication Data

US 2020/0048884 A1 Feb. 13, 2020

(30) Foreign Application Priority Data

Apr. 13, 2017 (DE) ..... 202017102237.4

(51) Int. Cl.
*E03C 1/10* (2006.01)
*E03C 1/05* (2006.01)
(Continued)

(52) U.S. Cl.
CPC ..... *E03C 1/10* (2013.01); *E03C 1/055* (2013.01); *E03D 1/00* (2013.01); *E03D 9/08* (2013.01); *E03D 9/085* (2013.01)

(58) Field of Classification Search
CPC .. E03D 9/085; E03D 9/08; E03D 1/00; E03D 1/32; E03C 1/10
See application file for complete search history.

(56) References Cited

U.S. PATENT DOCUMENTS 5,142,711 A * 9/1992 Parikh ..... E03D 9/08 4/420.4
6,973,679 B1 * 12/2005 Schad ..... E03D 9/085 4/420.4
(Continued)

FOREIGN PATENT DOCUMENTS

CH 690587 10/2000
CH 690587 A5 * 10/2000 ..... E03D 9/06
(Continued)

OTHER PUBLICATIONS

Machine translation of FR2974126. Retrieved from Espacenet. (Year: 2021).*
Machine translation of DE2702927A1. Espacenet. (Year: 2021).*

*Primary Examiner* — Erin Deery
(74) *Attorney, Agent, or Firm* — Volpe Koenig

(57) ABSTRACT

A WC cistern (1) with a wall (2) which forms a substantially cuboidal water tank (3). An intake (5) with which the water tank (3) can be filled is guided through the wall (2). A shutoff valve (7) is arranged in the intake (5), the shutoff valve interacting with a switch-off device (8) which triggers the shutoff valve (7) when a switch-off level (14) in the water tank (3) is reached. An injector (15) is arranged in the water tank (3) in a construction space (13) above the switch-off level (14). The outflow-side outlet (16) of the injector (15) is led out of the water tank (3).

17 Claims, 6 Drawing Sheets

(51) Int. Cl.
*E03D 1/00* (2006.01)
*E03D 9/08* (2006.01)

(56) References Cited

U.S. PATENT DOCUMENTS

| | | | | |
|---|---|---|---|---|
| 9,909,294 | B2 | 3/2018 | Hauth | |
| 2015/0033464 | A1 * | 2/2015 | Hauth | E03D 9/08 4/448 |

FOREIGN PATENT DOCUMENTS

| | | | | |
|---|---|---|---|---|
| CN | 1932174 | | 3/2007 | |
| CN | 2923852 | | 7/2007 | |
| CN | 104846975 | | 8/2015 | |
| CN | 206034592 | | 3/2017 | |
| DE | 2534662 | | 2/1977 | |
| DE | 2702927 | | 7/1977 | |
| DE | 19742278 | A1 * | 3/1999 | A47K 7/08 |
| DE | 20004554 | | 4/2001 | |
| DE | 202013002055 | | 8/2013 | |
| DE | 102013003629 | | 9/2013 | |
| DE | 202015105231 | U1 * | 11/2015 | E03D 9/085 |
| EP | 1449968 | | 8/2004 | |
| EP | 2275610 | | 1/2011 | |
| EP | 3231949 | | 10/2017 | |
| FR | 2923227 | A1 * | 5/2009 | E03C 1/023 |
| FR | 2974126 | | 10/2012 | |
| JP | S61102925 | | 5/1986 | |
| JP | 2003253726 | | 9/2003 | |
| JP | 2004257095 | | 9/2004 | |
| JP | 2005163398 | | 6/2005 | |
| JP | 2008156879 | | 7/2008 | |
| JP | 2008223357 | | 9/2008 | |
| WO | 2009124866 | | 10/2009 | |
| WO | 2015143571 | | 10/2015 | |

* cited by examiner

TOILET CISTERN WITH BIDET SPRAY HEAD AND INJECTOR, AND USE THEREOF

BACKGROUND

The invention describes a WC cistern, with a wall forming a water tank and with an intake which is guided through the wall and with which the water tank can be filled, wherein a shutoff valve is arranged in the intake, said shutoff valve interacting with a shutoff device when a switch-off level in the water tank is reached.

Such WC cisterns are known in general and in various embodiments in the prior art. For example, there are cisterns for mounting on a wall, in a front wall, or cisterns which stand on a WC. In addition there are also front wall elements which contain a WC cistern.

In some cultural circles, it is customary, in addition to the WC, to provide a shower fitting, for example a Shattaf shower, for hygiene purposes. However, for this purpose, in addition to the water connection for the WC cistern, a separate water connection has to be provided for the shower fitting. Furthermore, such a water connection can also be used for cleaning purposes. However, this requires an additional installation, which is complicated and expensive.

SUMMARY

It is the object of the invention to provide a simpler and more cost-effective solution here.

This object is achieved by a WC cistern with one or more features of the invention.

Accordingly, the cistern according to the invention comprises an injector being arranged in the water tank in a construction space above the switch-off level, and an outflow-side outlet of the injector being led out of the water tank. Said outlet can serve as an additional water connection. In the case of this WC cistern, it is therefore possible to connect, for example, a shower fitting for hygiene purposes or other purposes, to the outflow-side outlet.

By use of the injector within the WC cistern, first of all the water supply to the outlet is ensured. Secondly, a backflow from the outlet into the fresh water intake is prevented. Water flowing back, or water flowing in at the outlet simply flows here into the cistern. It is therefore also possible to prevent, in the event of a negative pressure in a connecting line conducting drinking water, waste water being sucked back into the connecting line at the intake, for example during venting.

A further advantage of the injector consists in that it virtually provides the water pressure of the intake at the outlet. Applications requiring water pressure are therefore also possible at the outlet.

Overall, by use of the WC cistern according to the invention, an additional water connection can be available without necessitating a complicated and expensive sanitary installation.

An additional advantage is provided in that by exchange or by retrofitting an existing WC cistern, an additional water connection of this type can installed without retrospective sanitary installation.

The injector can be characterized by a horizontal installation position in particular of its free jet section. This permits a low overall height. Furthermore, the required standard distance between waste water and flushing water in the bowl is reduced, as a result of which a more compact overall height is possible.

In an advantageous embodiment, an overflow pipe is arranged in a drain of the water tank, said overflow pipe projecting into an interior space of the water tank in order to define a maximum filling level, and the injector is arranged above the maximum filling level. The overflow pipe prevents the WC cistern from being filled over the defined maximum level. This prevents the injector which is arranged above the maximum level filling up with water or sinking in the water, for example should the previously described switch-off device be defective. It is therefore possible to prevent waste water from being sucked back out of the water tank at the intake when there is a negative pressure in a connecting line conducting drinking water.

In an expedient embodiment of the invention, the injector has a free jet section. The separation and therefore the backflow of the outlet from the intake is therefore ensured by said free jet section.

The free jet section is preferably oriented horizontally and is open downward into the water tank. This ensures that possibly backflowing water can pass unobstructed into the WC cistern and not in any way into the intake.

An advantageous embodiment comprises the injector having, at an outflow-side end of a free jet section, a collecting opening which is formed on a projection protruding counter to a jet direction determined by the free jet section. The projection can act here as a funnel and can ensure that as far as possible all of the water passes to the outlet. The projection can prevent water from creeping or trickling into the collecting opening from a region in the environment of the collecting opening.

In a particularly expedient embodiment, the injector can be switched off on the inflow side by a valve. The outlet can thereby already be deactivated on an inflow side. It can thus be prevented in a simple manner that water can be removed at the outlet. This can be necessary or advantageous, for example, in the event of a defect in the outlet line.

The valve can be designed, for example, as a ball valve or as a screw valve.

A, for example, mechanical actuating device can be present for actuating the valve. This actuating device can have, for example, a lever or a rotary wheel.

However, it is particularly advantageous if the valve is actuable electrically. The actuating device here can be, for example, a switch or pushbutton. This permits actuation of a valve which is arranged at a location to which access is difficult, in particular over large distances and/or in the event of constricted space conditions.

It is particularly advantageous if there is a contactlessly activatable actuating device of the valve. This actuating device can comprise, for example, a solenoid valve or a valve driven by an electric motor. For the supply of power, a mains connection and/or batteries can be provided. In an expedient refinement, the actuating device is fed from an electrical energy accumulator. The latter can comprise, for example, a storage battery.

One embodiment of the invention has a generator which is arranged in the intake and is configured for charging the energy accumulator. An independent WC cistern in particular without an energy supply connection can therefore be provided. This generator can have, for example, a water wheel which is driven by the water flow in the intake. Electrical energy for switching the valve can thereby be obtained in a simple manner.

The injector can be connected to the intake with which the water tank can be filled, and therefore only a water connection for the WC cistern is necessary to the outside.

In an alternative embodiment, a feed line of the injector can be guided into the water tank separately from the intake.

In one embodiment of the invention, the outlet of the injector leads into a backflow-protected water connection. The water connection can have a thread for the connection of accessories.

In an advantageous embodiment, a cleaning unit, in particular a shower which can be switched off, preferably a Shattaf shower, is connected or can be connected to the injector, in particular to the backflow-protected water connection. Specifically in the case of Shattaf showers or similar connection devices connected via a hose, backflow prevention is desirable or required because it is not possible to prevent the connection device from being submerged in a water tank while negative pressure arises in the water line.

The invention also comprises the use of an injector in a WC cistern for providing a backflow-protected water connection to the WC cistern. The use of an injector has the advantage that—because of the horizontal installation position of the injector—a lower overall height can be maintained.

It is particularly advantageous here if a cleaning unit, in particular a shower which can be switched off, preferably a Shattaf shower, is connected to the backflow-protected water connection.

BRIEF DESCRIPTION OF THE DRAWINGS

The invention is explained in more detail below using a number of advantageous exemplary embodiments with reference to the attached drawings. The examples here serve merely for clarification of the invention and are in no way limiting.

In the drawings

DETAILED DESCRIPTION

Figure 1:
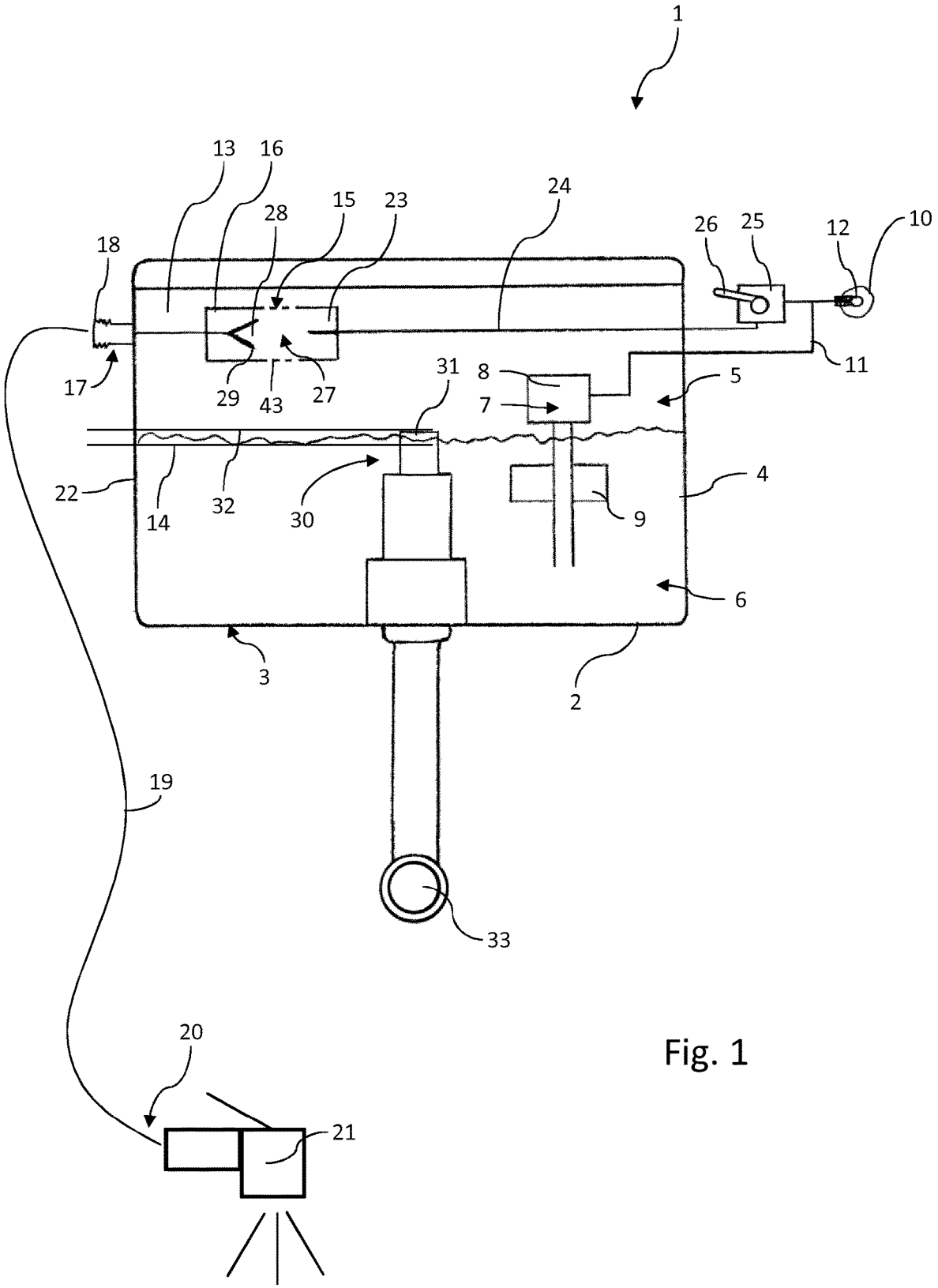
FIG. 1: shows a first embodiment of a WC cistern according to the invention with an external valve for the injector.

FIG. 1 shows a WC cistern 1 according to the invention with a wall 2 which, in the example, forms a substantially cuboidal water tank 3. In further exemplary embodiments, water tanks having different geometrical basic shapes are realized.

An intake 5 with which the water tank 3 can be filled with water 6 is guided through the wall 2 in FIG. 1 on a narrow side 4. A shutoff valve 7 which interacts with a switch-off device 8 is arranged in the intake 5. This switch-off device 8 can have, for example, a float 9 which floats on the water 6 in the water tank 3 or floats in the water 6. When a switch-off level 14 in the water tank 3 is reached, the float 9 triggers the shutoff valve 7, and therefore no more water 6 flows in through the intake 5.

Outside the WC cistern 1, the intake 5 is connected to a water connection 10, for example via a line 11. The water connection 10 has a shutoff valve 12 by which the water supply to the intake 5 can be interrupted from the outside.

An injector 15 is arranged horizontally in the water tank 3 in a construction space 13 above the switch-off level 14. The outflow-side outlet 16 of the injector 15 is led out of the water tank 3 through a water outlet 17. The water outlet 17 lies above the switch-off level 14 and, in the example, has an external thread 18. In the example, a hose line 19, having a Shattaf shower 21 connected to the free end 20 thereof, is connected to the water outlet 17. Of course, other devices can also be connected to the hose line 19 or to the water outlet 17.

In the example, the water outlet 17 is arranged on that side 22 of the wall 2 which lies opposite the intake 5. Of course, the water outlet 17 can also be arranged at a different location on the wall 2.

The inlet 23 of the injector 15 is connected via an internal line 24 to a valve 25 arranged outside the WC cistern 1. The valve 25 is connected to the water connection 10 and has an actuating device 26 with which the valve 25 can be opened or closed. The inflow to the injector 15 can thereby be suppressed. In the example, the valve 25 is designed as a ball valve and the actuating device 26 as a lever.

The injector 15 has a free jet section 27 which substantially prevents the backflow from the outlet 16 to the inlet 23. In the example, the free jet section 27 is oriented horizontally and is open downward into the water tank 3. Water flowing back through the outlet 16 therefore flows through said opening 43 into the water tank 3 and cannot pass into the inlet 23 of the injector. The injector 15 therefore brings about backflow protection for the water outlet 17.

The free jet section 27 in the example also has a collecting opening 28 which is formed on a projection 29 protruding counter to a jet direction determined by the free jet section 27.

An overflow pipe 31 which projects into an interior space of the water tank 3 in order to define a maximum level 32 is arranged in a drain 30 of the water tank 3. The injector 15 is preferably also arranged above the maximum level 32 in order to prevent the injector 15 from being filled with water 6 and therefore a separation between inlet 23 and outlet 16 no longer being provided.

In addition, the WC cistern 1 has an outflow 33 for the flushing water and an actuation 34 (FIG. 6) for triggering the flushing operation, which outflow and actuation are known per se and are therefore not explained in more detail here.

Figure 2:
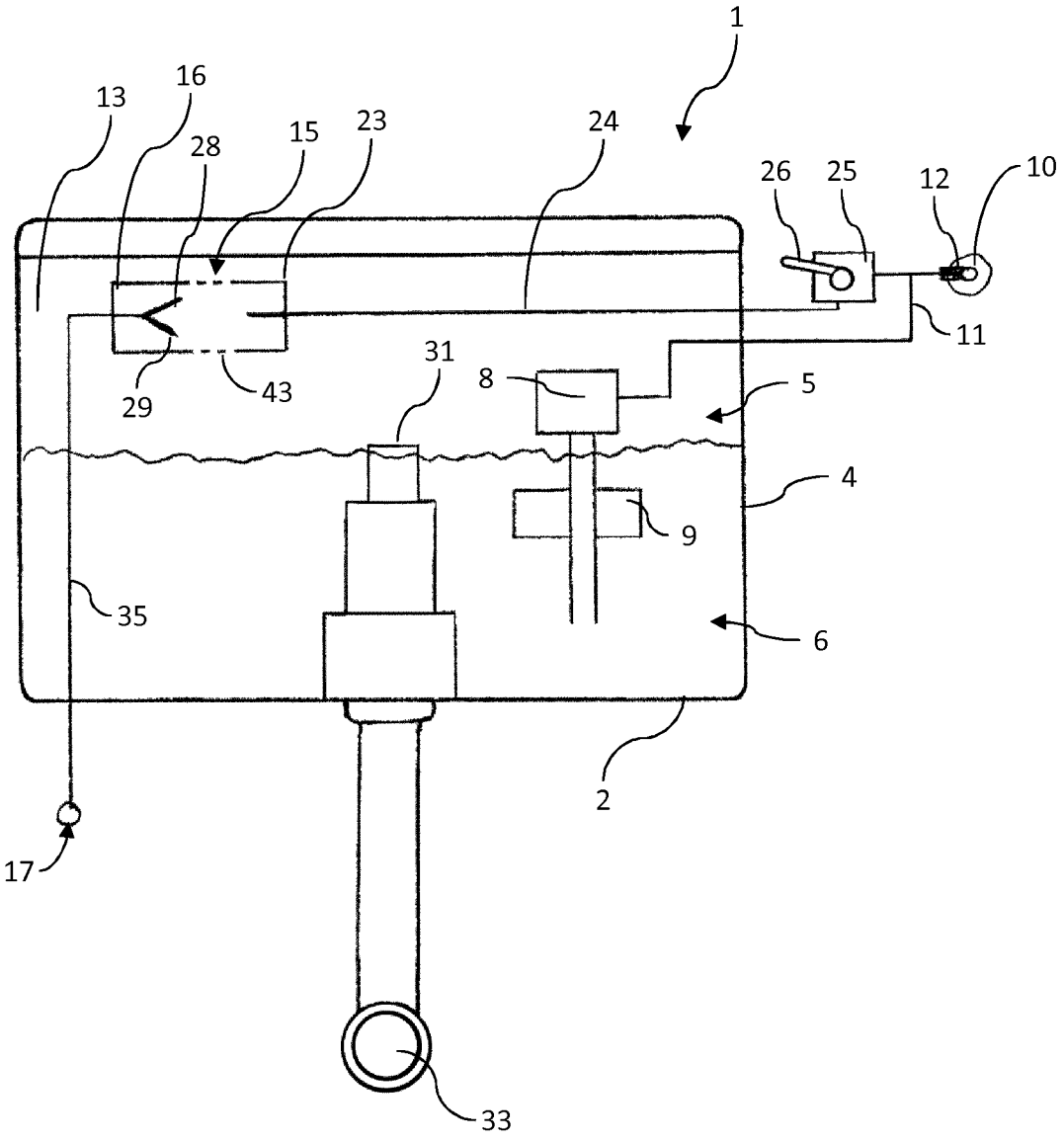
FIG. 2: shows a second embodiment of a WC cistern according to the invention with an external valve for the injector and an outlet line through the cistern.

FIG. 2 shows a WC cistern 1 which substantially corresponds to the WC cistern 1 of FIG. 1. The statements regarding FIG. 1 can therefore also be read on the exemplary embodiment according to FIG. 2. For this purpose, the reference signs have been provided analogously to FIG. 1.

However, in the exemplary embodiment according to FIG. 2, the outlet 16 of the injector 15 is led out of the water tank 3 via a closed line 35. FIG. 2 shows that the outlet 16 is led out through the lower wall of the water tank 3. In further exemplary embodiments, the line 35 can be guided at any other position. As a result, the water outlet 17 can be placed at a position adapted to the installation location.

Figure 3:
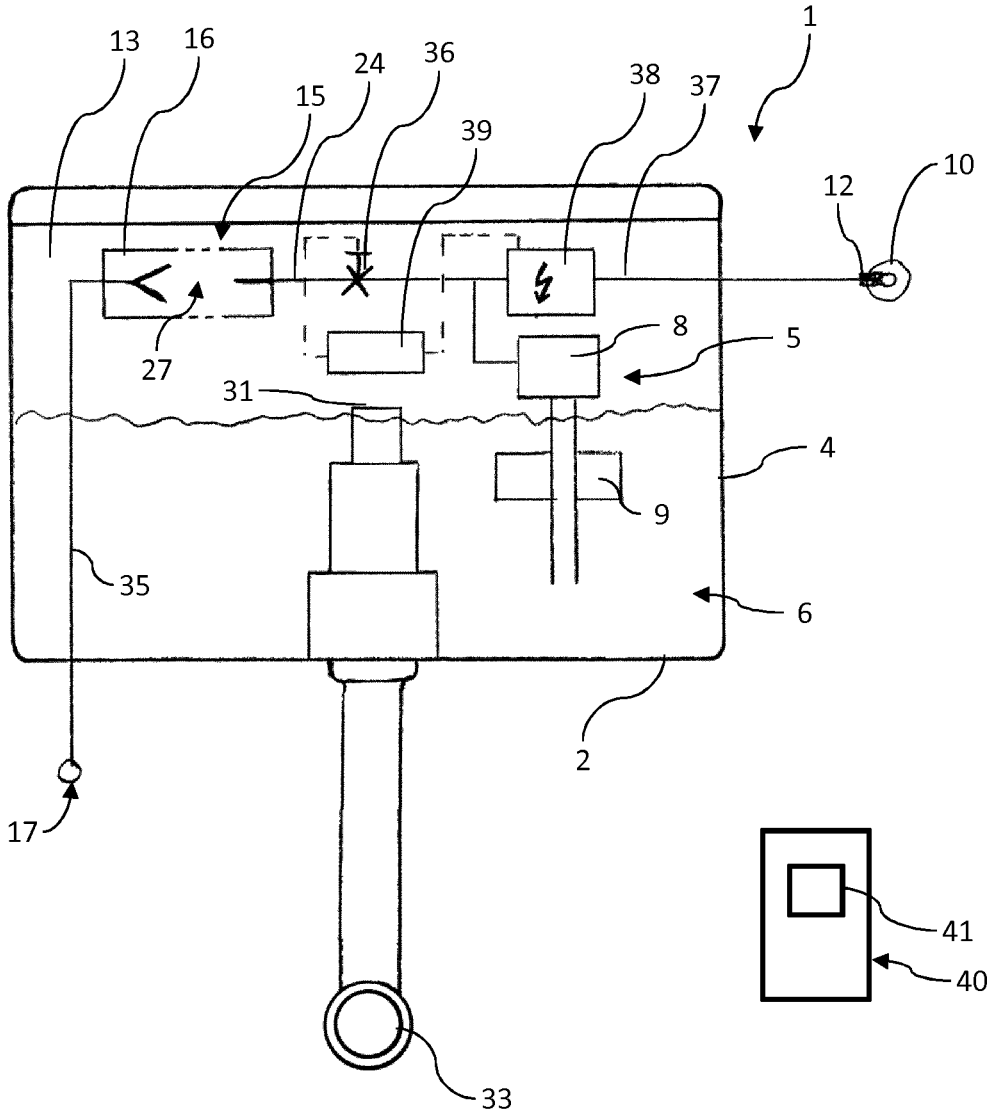
FIG. 3: shows a third embodiment of a WC cistern according to the invention with an internal valve for the injector and an outlet line through the cistern.

FIG. 3 shows an alternative embodiment of a WC cistern 1 according to the invention. The same reference signs are again used and therefore the explanations with respect to FIGS. 1 and 2 can be read on FIG. 3.

However, in contrast to the embodiment of FIG. 2, this embodiment has an electrically actuated valve 36 in the line 24 to the injector 15, said valve being arranged within the construction space 13 above the maximum level 32. For the energy supply of the electrical valve 36, a generator 38 for generating electrical energy is arranged in the feed line 37. This generator 38 converts flow energy of the water into electrical energy. For this purpose, the generator 38 can have a water wheel which is driven by the water flow. The water wheel can be connected to a dynamo. The intake 5 for filling the water tank 3 is arranged downstream of said generator 38. Electrical energy is thereby generated during each flushing operation, i.e. during each filling operation. The WC cistern 1 can have an energy accumulator, for example a storage battery, in which excess electrical energy is stored. In further exemplary embodiments, the energy accumulator can be charged in a different manner, for example by energy harvesting.

In order to actuate the electrical valve 36, a switch or pushbutton can be arranged on the WC cistern 1. In the example, the electrical valve 36 has a contactlessly activatable actuating device 39. For this purpose, there is a remote control 40 which has a trigger button 41. This remote control 40 can be connected to the actuating device 39 by radio or infrared light. The valve 36 can be switched on and off here via the trigger button 41. However, it can also have a time control, and therefore the valve 36 after opening is automatically closed after a selectable time.

Figure 4:
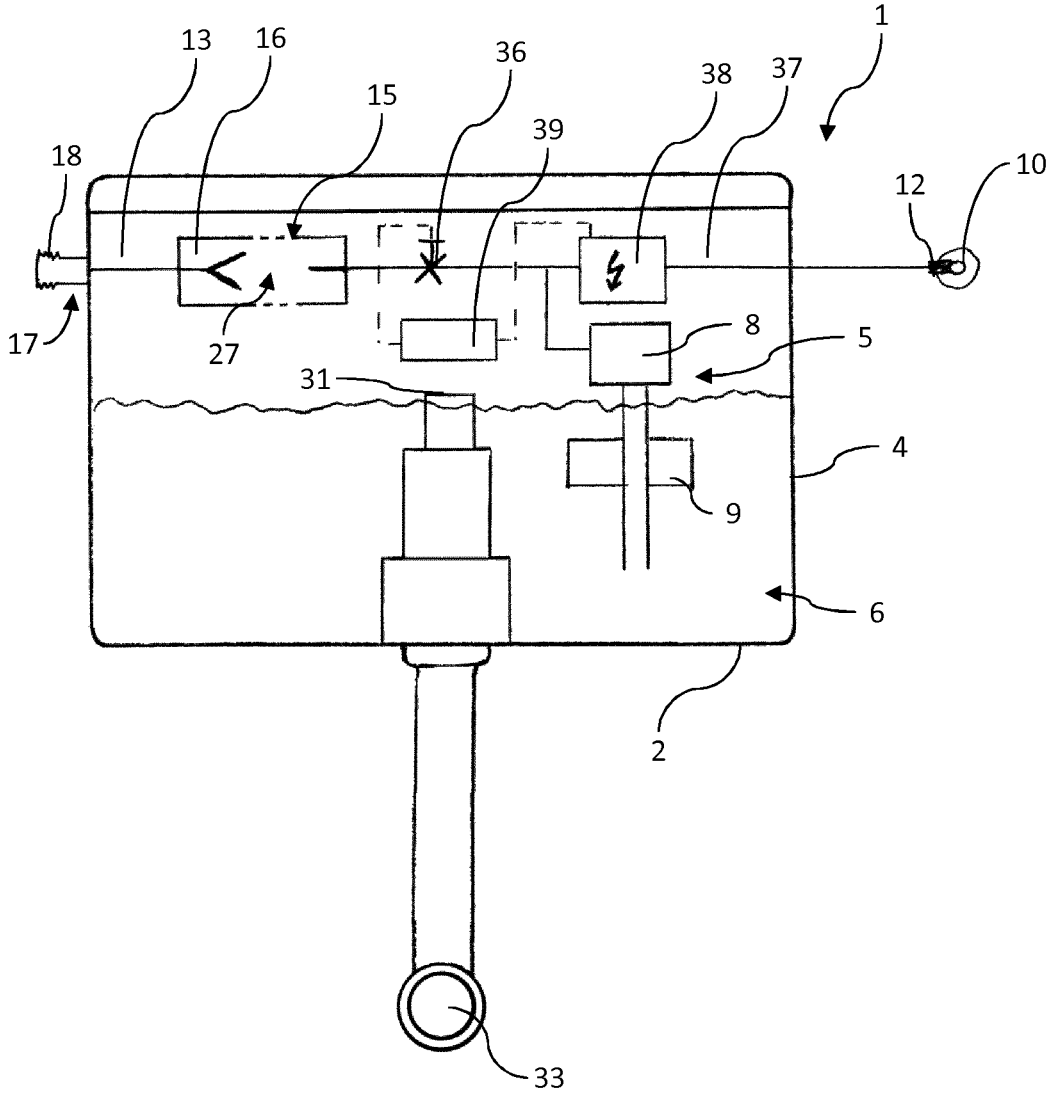
FIG. 4: shows a fourth embodiment of a WC cistern according to the invention with an internal valve for the injector.

The embodiment shown in FIG. 4 is a combination of the embodiments of FIGS. 1 and 3. It has an electrical valve 36 according to FIG. 3 and a water outlet 17 according to FIG. 1.

Figure 5:
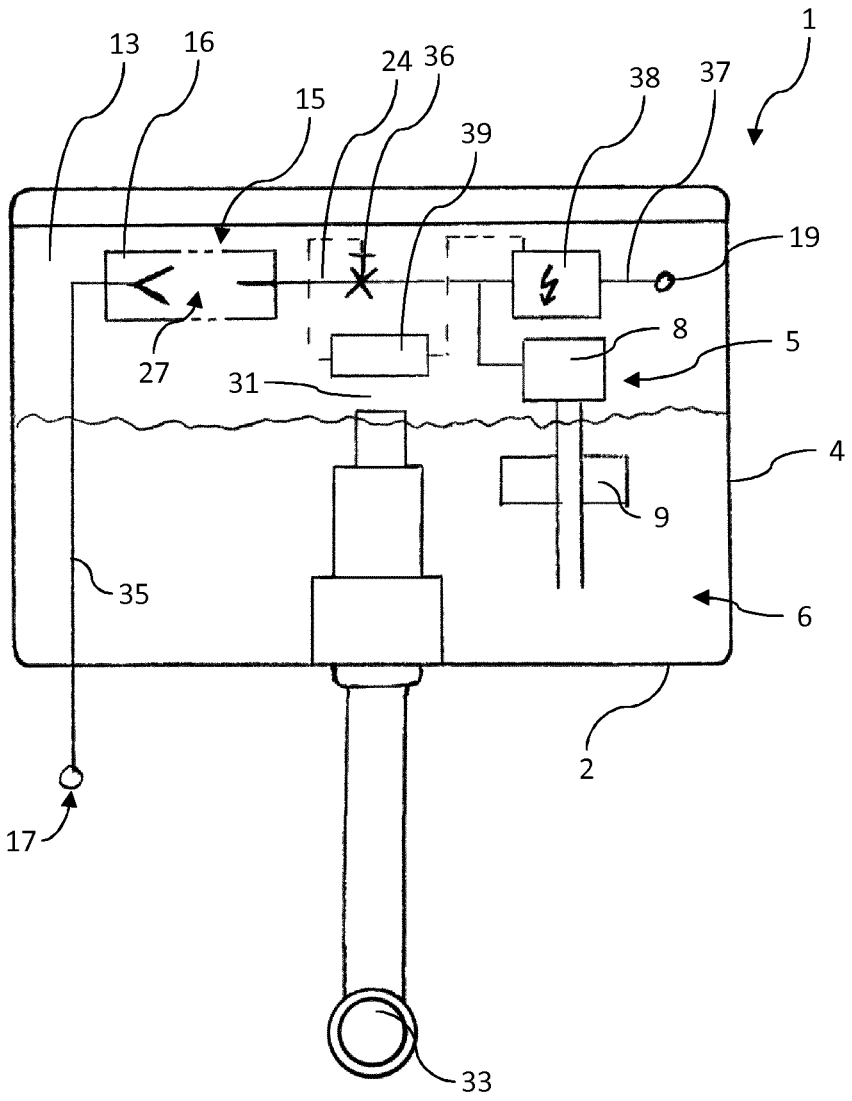
FIG. 5: shows a fifth embodiment of a WC cistern according to the invention with an internal valve for the injector with an outlet line through the cistern.

The embodiment in FIG. 5 is a variant of the embodiment of FIG. 3, wherein the intake 5 takes place here via an internal water connection 10.

The WC cisterns of FIGS. 1 to 5 are each designed as independent units which are mounted hanging on a wall or standing on a WC.

Figure 6:
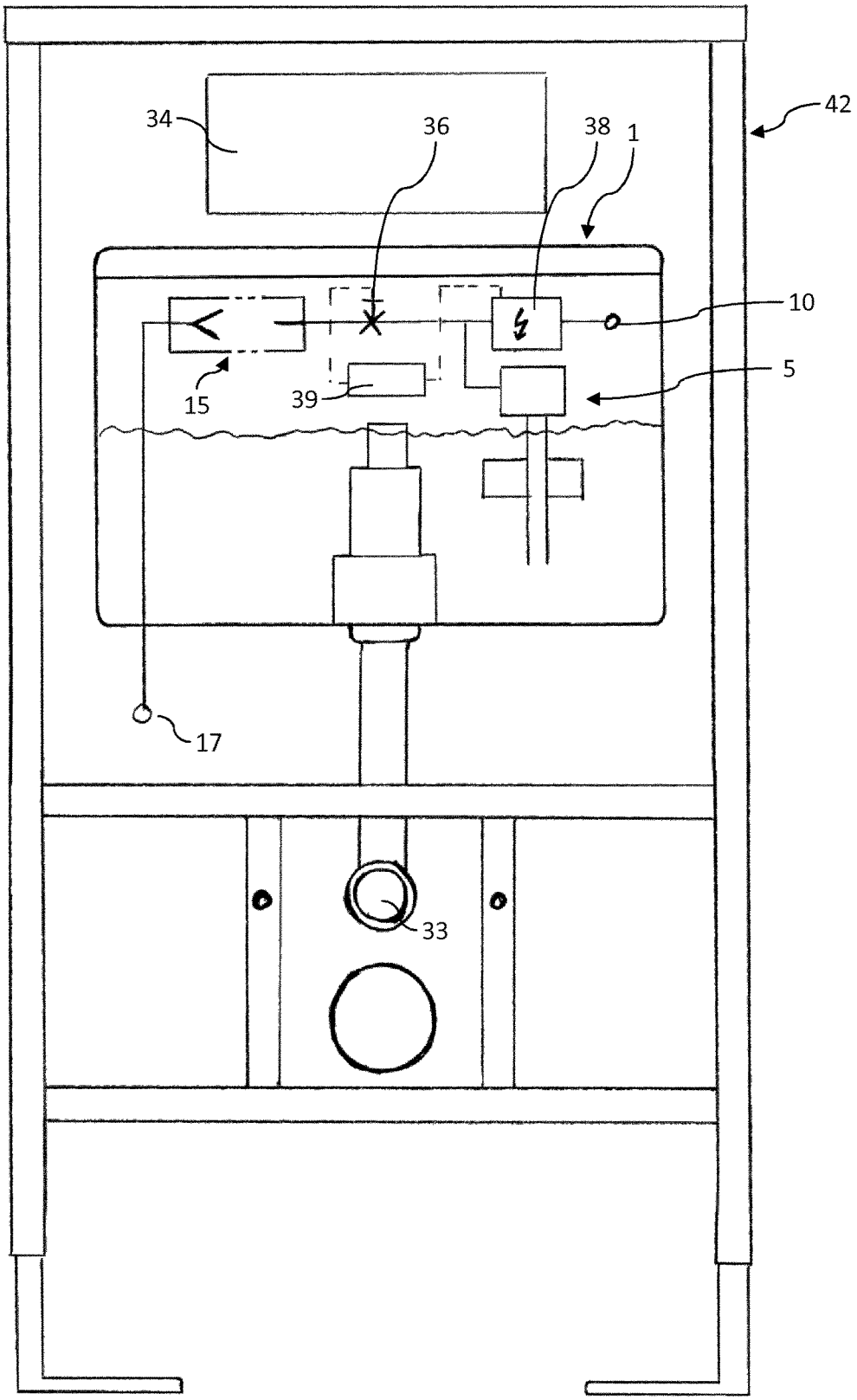
FIG. 6: shows a front wall element with a WC cistern according to FIG. 5.

FIG. 6 finally shows a conventional front wall element 42 in which a WC cistern 1 according to FIG. 5 is arranged. The front wall element 42 serves for installation in a front wall installation. Such front wall elements are known per se, and therefore the further features of said front wall element 42 will not be discussed in more detail.

The invention therefore provides a WC cistern 1 with a wall 2 which forms a substantially cuboidal water tank 3. An intake 5 with which the water tank 3 can be filled is guided through the wall 2. A shutoff valve 7 is arranged in the intake 5, said shutoff valve interacting with a switch-off device 8 which triggers the shutoff valve 7 when a switch-off level 14 in the water tank 3 is reached. An injector 15 is arranged in the water tank 3 in a construction space 13 above the switch-off level 14. The outflow-side outlet 16 of the injector 15 is led out of the water tank 3.

LIST OF REFERENCE SIGNS

1 WC cistern
2 Wall
3 Water tank
4 Narrow side
5 Intake
6 Water
7 Shutoff valve in the intake
8 Switch-off device
9 Float
10 Water connection
11 Line
12 Shutoff valve on the water connection
13 Construction space
14 Switch-off level
15 Injector
16 Outlet of the injector
17 Water outlet
18 External thread
19 Hose line
20 Free end
21 Shattaf shower
22 Opposite side
23 Inlet of the injector
24 Internal line to the injector
25 Valve
26 Actuating device
27 Free jet section
28 Collecting opening
29 Projection
30 Drain
31 Overflow pipe
32 Maximum level
33 Outflow
34 Actuation
35 Closed line
36 Electrical valve
37 Feed line
38 Generator
39 Contactless actuating device
40 Remote control
41 Trigger button
42 Front wall element

The invention claimed is:

1. A WC cistern (1), comprising:
a wall (2) forming a water tank (3),
an intake (5) which is guided through the wall (2) and with which the water tank (3) is adapted to be filled,
a shutoff valve (7) arranged in the intake (5),
a shutoff device (8), said shutoff valve interacting with the shutoff device (8) when a switch-off level (14) in the water tank (3) is reached,
an injector (15), having an outflow-side outlet (16), is arranged in the water tank (3) in a construction space (13) above the switch-off level (14), wherein the injector (15), prevents backflow from the outlet (16) into the intake (5) and has a free jet section (27) which is open downward into the water tank (3), and the outflow-side outlet (16) is led out of the water tank (3), wherein the outlet (16) of the injector (15) leads out of the water tank (3) into a backflow-protected water outlet (17), which has an external thread (18) such that various devices are connectable to the water outlet (17).

2. The WC cistern (1) as claimed in claim 1, further comprising an overflow pipe (31) arranged in a drain (30) of the water tank (3), said overflow pipe projecting into an interior space of the water tank (3) to define a maximum filling level (32), and the injector (15) is arranged above the maximum filling level (32).

3. The WC cistern (1) as claimed in claim 1, wherein the injector (15) has, at an outflow-side end of the free jet section (27), a collecting opening (28) which is formed on a projection (29) protruding counter to a jet direction determined by the free jet section (27).

4. The WC cistern (1) as claimed in claim 1, wherein the injector (15) is switchable to off on an inflow side by a valve (25, 36).

5. The WC cistern (1) as claimed in claim 4, further comprising an actuating device (26, 39) for the valve (25, 36) that is fed from an electrical energy accumulator.

6. The WC cistern (1) as claimed in claim 5, wherein the energy accumulator is chargeable from a generator (38) arranged in the intake.

7. The WC cistern (1) as claimed in claim 4, wherein the valve is electrically actuable.

8. The WC cistern (1) as claimed in claim 1, wherein the injector (15) is fed from the intake (5).

9. The WC cistern (1) as claimed in claim 1, further comprising a cleaning unit (21) connected to the injector (15).

10. The WC cistern (1) as claimed in claim 9, wherein the cleaning unit is a shower which is switchable to off.

11. The WC cistern (1) as claimed in claim 9, wherein the cleaning unit (21) is connected to a backflow-protected water connection (19) of the injector.

12. The WC cistern (1) as claimed in claim 1, wherein the free jet section (27) extends horizontally.

13. The WC cistern (1) as claimed in claim 1, further comprising a feed line (24) of the injector (15) that is guided separately from the intake (5) into the water tank (3).

14. The WC cistern as claimed in claim 1, wherein a hose line (19), comprising a handheld sprayer (21) is connected to the water outlet (17).

15. A method of using the WC cistern (1) of claim 1, comprising connecting a backflow-protected water connection (19) to the outlet (17) of the injector (15).

16. The method as claimed in claim 15, further comprising connecting a cleaning unit (21) to the backflow-protected water connection (19).

17. A method of providing an additional water connection to a WC cistern having an intake (5) that is guided through a wall (2) forming a water tank (3), with which the water tank (3) is adapted to be filled, and a shutoff valve (7) arranged in the intake (5), said shutoff valve interacting with a shutoff device (8) when a switch-off level (14) in the water tank (3) is reached, the method comprising:

arranging an injector (15) in the water tank (3) in a construction space (13) above the switch-off level (14), wherein the injector (15) has a free jet section (27) which is open downward into the water tank (3), and leading an outflow-side outlet (16) of the injector out of the water tank (3) to an external connection, wherein the injector (15) prevents backflow from the outlet (16) into the intake (5), wherein the outlet (16) of the injector (15) leads out of the water tank (3) into a backflow-protected water outlet (17), which has an external thread (18) and wherein a shower device, comprising a hose line (19) having a handheld sprayer (21), is connected to the water outlet (17).

* * * * *